US012471721B2

(12) United States Patent
Ribot

(10) Patent No.: US 12,471,721 B2
(45) Date of Patent: Nov. 18, 2025

(54) DEVICE FOR DISPENSING AT LEAST ONE BULK FOOD PRODUCT, AND ASSOCIATED SYSTEM

(71) Applicant: AGROPESAGE, Beaucaire (FR)

(72) Inventor: Christophe Ribot, Lambesc (FR)

(73) Assignee: AGROPESAGE, Beaucaire (FR)

( * ) Notice: Subject to any disclaimer, the term of this patent is extended or adjusted under 35 U.S.C. 154(b) by 213 days.

(21) Appl. No.: 18/287,708

(22) PCT Filed: Apr. 20, 2022

(86) PCT No.: PCT/FR2022/050741
§ 371 (c)(1),
(2) Date: Oct. 20, 2023

(87) PCT Pub. No.: WO2022/223926
PCT Pub. Date: Oct. 27, 2022

(65) Prior Publication Data

US 2024/0180341 A1 Jun. 6, 2024

(30) Foreign Application Priority Data

Apr. 21, 2021 (FR) ..... 21/04136

(51) Int. Cl.
*A47F 1/03* (2006.01)

(52) U.S. Cl.
CPC ..... *A47F 1/03* (2013.01)

(58) Field of Classification Search
CPC . A47F 1/03; A47F 1/035; B65D 37/04; G01F 11/24; A47G 19/34
See application file for complete search history.

(56) References Cited

U.S. PATENT DOCUMENTS 4,130,224 A * 12/1978 Norman ..... G01F 11/088 222/207
4,349,133 A 9/1982 Christine
(Continued)

FOREIGN PATENT DOCUMENTS

EP 2294948 A1 3/2011
EP 2599406 B1 5/2015

OTHER PUBLICATIONS

International Search Report dated Jul. 20, 2022; International Application No. PCT/FR2022/050741; 2 pages (English).
(Continued)

*Primary Examiner* — Vishal Pancholi
(74) *Attorney, Agent, or Firm* — CANTOR COLBURN LLP

(57) ABSTRACT

Disclosed is a device for dispensing at least one bulk food product, which includes a first portion and a second portion, the first portion being capable of suspending a first side of the bag, the second portion comprising a pouring spout and a clamping mechanism configured for clamping a second side of the bag opposite the first side, and which comprises at least one first blade and one second blade, which are flexibly deformable between a closing position in which the blades are unconstrained and are configured to hold the second side of the bag closed, and an open position in which the blades are constrained to flex and move away from one another and are configured to release the second side of the bag so as to deliver the food product via the pouring spout.

20 Claims, 5 Drawing Sheets

(56) References Cited

U.S. PATENT DOCUMENTS

| | | | | | |
|---|---|---|---|---|---|
| 4,463,876 | A | * | 8/1984 | Swallert | A47K 5/1215 222/105 |
| 4,515,294 | A | * | 5/1985 | Udall | B65D 77/065 222/105 |
| 4,564,127 | A | * | 1/1986 | Garabedian | A47K 5/1215 222/105 |
| 4,573,612 | A | * | 3/1986 | Maddison | A47K 5/1209 222/105 |
| 4,715,517 | A | * | 12/1987 | Potter | B67D 7/0205 222/212 |
| 5,597,093 | A | * | 1/1997 | Lee | G01F 11/088 222/146.6 |
| 6,273,297 | B1 | | 8/2001 | Schalow et al. | |

OTHER PUBLICATIONS

International Search Report dated Jul. 20, 2022; International Application No. PCT/FR2022/050741; 3 pages (non-English).
Written Opinion dated Jul. 20, 2022; International Application No. PCT/FR2022/050741; 5 pages (non-English).

* cited by examiner

DEVICE FOR DISPENSING AT LEAST ONE BULK FOOD PRODUCT, AND ASSOCIATED SYSTEM

CROSS REFERENCE TO RELATED APPLICATIONS

This application is a National Stage of PCT Application No. PCT/FR2022/050741 filed on Apr. 20, 2022, which claims priority to French Patent Application No. 21/04136 filed on Apr. 21, 2021, the contents each of which are incorporated herein by reference thereto.

TECHNICAL FIELD

The present disclosure relates to a device for bulk dispensing at least one food product, as well as to a storage and dispensing system comprising such a device.

It relates more particularly to the field of the bulk dispensing of food products, such as for example and without limitation dried fruits, nuts, rice, pasta, semolina, seeds, cereals, sugar, sweets, dried vegetables such as lentils, chickpeas, quinoa, peas, etc. in bulk, particularly for dispensing and sales spaces such as stores, grocery stores and wholesalers.

BACKGROUND

We know bulk storage and dispensing devices mainly used in the field of the food dispensing of organic products. Such devices allow the metered dispensing to the consumer of a food product such as, for example, cereals, nuts, dried fruits, rice or pasta.

The bulk storage and dispensing devices generally comprise a plastic silo receiving the product to be stored and dispensed, a pouring spout connected to the silo and actuated by a lever, as known for example from documents EP2294948 and EP2599406. To receive the product from such a device, the consumer places a container, for example a bag, at the pouring spout and actuates the lever, a movable flap mounted in the pouring spout pivots to release the product it is holding. Then the product is poured into the consumer's container.

Particularly in the field of the bulk dispensing of organic products, such storage and dispensing devices need to be regularly cleaned in order to guarantee hygiene, a traceability of the products and to avoid any risk of product mixing, for example, when such a cleaned device is used to be filled with another food product.

The cleaning of such a device is carried out by removing at least the plastic silo to wash it using cleaning products, then dry it. Such a cleaning has the disadvantage of risking a contamination of the product that the silo will contain through the use of cleaning products.

Furthermore, after cleaning, it may be necessary to modify the labeling of these devices to obtain a traceability of the food products they contain.

The state of the art may also be illustrated by document U.S. Pat. No. 6,273,297 which proposes a device for dispensing a viscous liquid, such as a food sauce, contained in a pouch, and which implements a pinching mechanism for pinching a nose of the pouch between two jaws, one of the jaws being movable in translation to either squeeze and pinch this nose, or move aside and free the nose to release the viscous liquid out of the pouch. Suitable for a viscous liquid, this device is however unsuitable for a bulk food product, which comprises more or less large pieces which would hinder pinching by such jaws.

BRIEF SUMMARY

The present disclosure aims to remedy at least one of the aforementioned drawbacks, by proposing a bulk dispensing device which is configured to facilitate the replenishment and cleaning operations, or even to minimize the cleaning.

Another aim of the present disclosure is to propose a bulk dispensing device which is easy to use for dosing and serving, while offering optimal hygiene.

To this end, the present disclosure proposes a dispensing device for bulk dispensing at least one food product, this device comprising a first part and a second part configured for holding a flexible packaging bag containing the at least one food product, wherein the first part is configured to allow suspension of a first side of the bag, and the second part comprises a pouring spout supporting a pinching mechanism and a control mechanism for controlling the pinching mechanism, this pinching mechanism being configured to allow the pinching of a second side of the bag opposite the first side, and it comprises at least one first blade and one second blade deformable in flexion between:

- a closed position in which the blades are not mechanically constrained by the control mechanism and are configured to keep the second side of the bag closed and,
- an open position in which the blades are mechanically constrained by the control mechanism to be deformed in flexion and thus move away from each other to release the second side of the bag so as to deliver the food product through the pouring spout.

The present disclosure advantageously allows the use of the flexible bag used as a silo in the dispensing device. We then overcome the constraints linked to the cleaning known from the prior art. Furthermore, the use of the flexible bag as a dispensing silo preserves the traceability of the product and avoids any unwanted mixing.

Such a pinching mechanism advantageously makes it possible to ensure closing or opening of the second side of the flexible packaging bag (and more precisely of a dispensing opening provided on this second side of the bag) so that it can be delivered or not the food product(s) contained in the bag without the device being in contact with the product(s) contained in the packaging bag.

In one advantageous embodiment, the pinching mechanism is detachably mounted in the second part, in particular in the pouring spout.

To insert a packaging bag into the device of the present disclosure, the pinching mechanism may thus be removed from the pouring spout of the second part, the blades are then spaced apart from each other to allow pinching of the second side of the bag intended for the delivery of the product(s) contained in the bag. The pinching mechanism and the packaging bag are then placed on the device by inserting the pinching mechanism into the second part and suspending the first side of the bag from the first part of the device.

The device according to the present disclosure allows the monitoring of the expiry dates since the packaging bag containing the food product(s) is not refilled but replaced by a new pre-filled packaging bag.

It should also be noted that the device does not require a cleaning phase and therefore avoids wasting water.

The second end of the packaging bag may be cut at any time once it has been pinched. Thus, the dispensing opening of the bag may for example be in the form of a spout to be cut once pinched.

According to another embodiment of the present disclosure, one end of the first blade is connected to one end of the second blade by a pivot connection around the same pivot axis.

According to another embodiment of the present disclosure, the control mechanism is movable in translation relative to the second part, the control mechanism being provided to detachably receive said pivot connection of the blades of the pinching mechanism and allow them to pivot about the pivot axis.

It is thus possible to manipulate the blades by actuating the control mechanism.

According to one variant of the present disclosure, the control mechanism comprises a hinge part ensuring the pivoting of the blades about the pivot axis, the hinge part being integral with at least one rod passing through the second part to be connected to a lever.

When the lever is pushed, the hinge part pushes the blades through the rod sliding in the second part.

Advantageously, the hinge part is integral with two rods, each rod being connected to the thrust lever.

The sliding of the rods relative to the second part is improved, the actuation of the blades is thus improved.

According to one embodiment of the present disclosure, the second part comprises a housing having, at the level of the blades, a generally oval shape limiting the authorized stroke of the blades of the pinching mechanism.

According to another embodiment of the present disclosure, the end of the first blade, called first end, is connected to the end of the second blade by the pivot connection, called first pivot connection, about the pivot axis, called first pivot axis, and the other end, called second end, of the first blade is connected to a second pivot connection about a second pivot axis, and the other end, called second end, of the second blade is connected to another second pivot connection about another second pivot axis.

According to one possibility, the second pivot connection and the other second pivot connection are distinct, with the second pivot axis parallel to and spaced apart from the other second pivot axis.

According to one variant, the second pivot connection and the other second pivot connection coincide with the second coaxial pivot axis or coincide with the other second pivot axis.

According to one embodiment of the present disclosure, each second pivot connection of the blades is connected to a spacer.

Thus, to reload the device, for example when the food product contained in the flexible bag is used up, simply remove the pinching mechanism and to separate the spacers pivoting by the second pivot connection and the other second pivot connection in order to remove the second side of the flexible bag stuck by the blades, and to replace a new bag pre-filled with the food product to be dispensed by wedging the second side of the new bag between these blades before replacing the pinching mechanism in the second part.

According to another embodiment of the present disclosure, the housing of the second part also has a shape complementary to the spacers so that, when the latter are received in the housing, they form a clamp configured to clamp the second side of the flexible bag.

Advantageously, the second part has two notches allowing two fingers to grasp the spacers in order to remove the pinching mechanism from the housing. According to one embodiment of the present disclosure, the first blade and the second blade have a predetermined curved profile allowing their spacing relative to each other.

In other words, each blade has a curved profile favoring the flexion of the blade concerned in a predetermined direction when these ends are compressed.

According to one variant of the present disclosure, the blades have faces opposite each other, each face including at least in part one deformable insulating layer disposed in correspondence.

According to one embodiment of the present disclosure, the first blade extends in a first longitudinal plane and the second blade extends in a second longitudinal plane in the closed position, the first end of each blade comprises a first pivot attachment having as its axis of rotation the first pivot axis, and the second end of the first blade comprises a second pivot attachment having as its axis of rotation the second pivot axis, and the second end of the second blade comprises a second pivot attachment having as its axis of rotation the other second pivot axis, and furthermore the first pivot axis and the second pivot axis of the first blade are separated by the first longitudinal plane, and the first pivot axis and the other second pivot axis of the second blade are separated by the second longitudinal plane in the closed position.

According to one embodiment of the present disclosure, the pinching mechanism comprises a plurality of first blades and a plurality of second blades.

The use of several distinct blades is particularly advantageous for trapping the bulk food products over the entire height of the pinching mechanism, and thus improving its sealing despite the presence of products stuck between the blades.

According to one possibility, the first blades extend in a first longitudinal plane in the closed position, the second blades extend in a second longitudinal plane in the closed position, the first plane and the second plane being distinct.

According to one variant of the present disclosure, the plurality of first blades and the plurality of second blades are arranged so that a first blade is superimposed on a second blade at the first pivot connection.

Advantageously, the first blades and the second blades are disposed alternately.

According to one embodiment of the present disclosure, the first part and the second part are separated from each other by an adjustment means, such an adjustment means allowing the setting of the distance between the first part and the second part relative to each other.

According to one variant of the present disclosure, the adjustment means is telescopic.

According to one variant of the present disclosure, the device comprises a hooking mechanism for suspending the dispensing device from a display.

According to one embodiment of the present disclosure, the first part is formed by a support bar configured to allow the attachment of the first side of the flexible bag.

Advantageously, the support bar comprises a label holder at its end.

According to another embodiment of the present disclosure, the first part is formed by a pivoting crown and configured to allow the attachment of the first side of the flexible bag.

Advantageously, the crown comprises a label holder at its end.

According to one embodiment of the present disclosure, the device comprises a structure for constraining the flexible packaging bag, disposed between the first part and the second part, the structure comprising reinforcements configured to clamp the flexible bag and constrain the product(s) it contains towards the pouring spout.

According to another aspect, the present disclosure concerns a system for bulk storing and dispensing at least one food product, comprising the device as defined above and a flexible packaging bag as defined, the flexible bag allowing the storage of said product.

According to the present disclosure, the bag has opposite first side and second side, where the first side of the bag is suspended on the first part of the device and the pinching mechanism allows the pinching of the second side, and in particular of a dispensing opening provided on this second side.

BRIEF DESCRIPTION OF THE DRAWINGS

Other features and advantages of the present disclosure will appear on reading the non-limiting description which follows and the appended figures which schematically illustrate several embodiments of the present disclosure.

DETAILED DESCRIPTION

Figure 1:
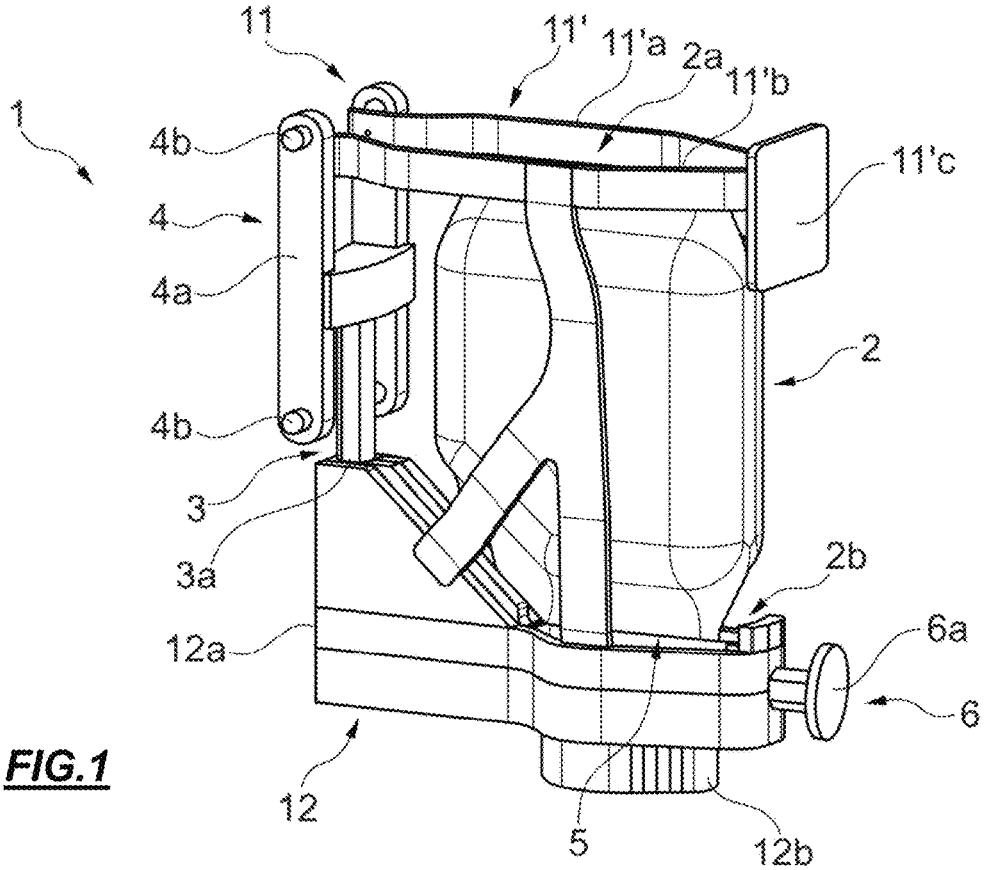
FIG. 1 represents a general perspective view of a first embodiment of a dispensing device according to the present disclosure equipped with a flexible packaging bag, the device comprises a first part and a second part separated by an adjustment means.

In FIG. 1, there is represented a first mode of a bulk dispensing device 1 equipped with a flexible packaging bag 2 containing one or several food products.

The device 1 comprises a first part 11 and a second part 12 configured for holding a flexible packaging bag 2 containing the food product(s).

The first part 11 and the second part 12 are separated from each other by an adjustment means 3 allowing the setting of the distance between the first part 11 and the second part 12 relative to each other according to the dimensions of the packaging bag 2 that the device 1 must receive.

According to this first embodiment, the first part 11 is formed by a crown 11' pivotally mounted relative to a mechanism 4 for hooking the device 1 to a display. The crown 11' comprises two longitudinal elements 11'*a*, 11'*b* intended to encircle a first side 2*a* of the flexible bag 2 which it contains. Furthermore, the crown 11' is provided to allow the attachment of the first side 2*a* of the flexible bag 2 in order to suspend it, for example using a clamp fastened both to the flexible bag 2 and to one element of the longitudinal elements 11'*a*, 11'*b*.

The longitudinal elements 11'*a*, 11'*b* are connected to each other by a label holder 11'*c* provided for displaying information relating to the product(s) contained in the flexible packaging bag 2.

As represented, the second part 12 comprises a body 12*a* detachably receiving a pinching mechanism 5 and further comprises a pouring spout 12*b* guiding the flow of the product(s) contained in the packaging bag 2.

The pinching mechanism 5 of the second part 12 is provided to pinch a second side 2*b* of the packaging bag 2 opposite the first side 2*a* suspended from the first part 11, and more specifically to pinch a dispensing opening provided on this second side 2*b*.

Figure 9:
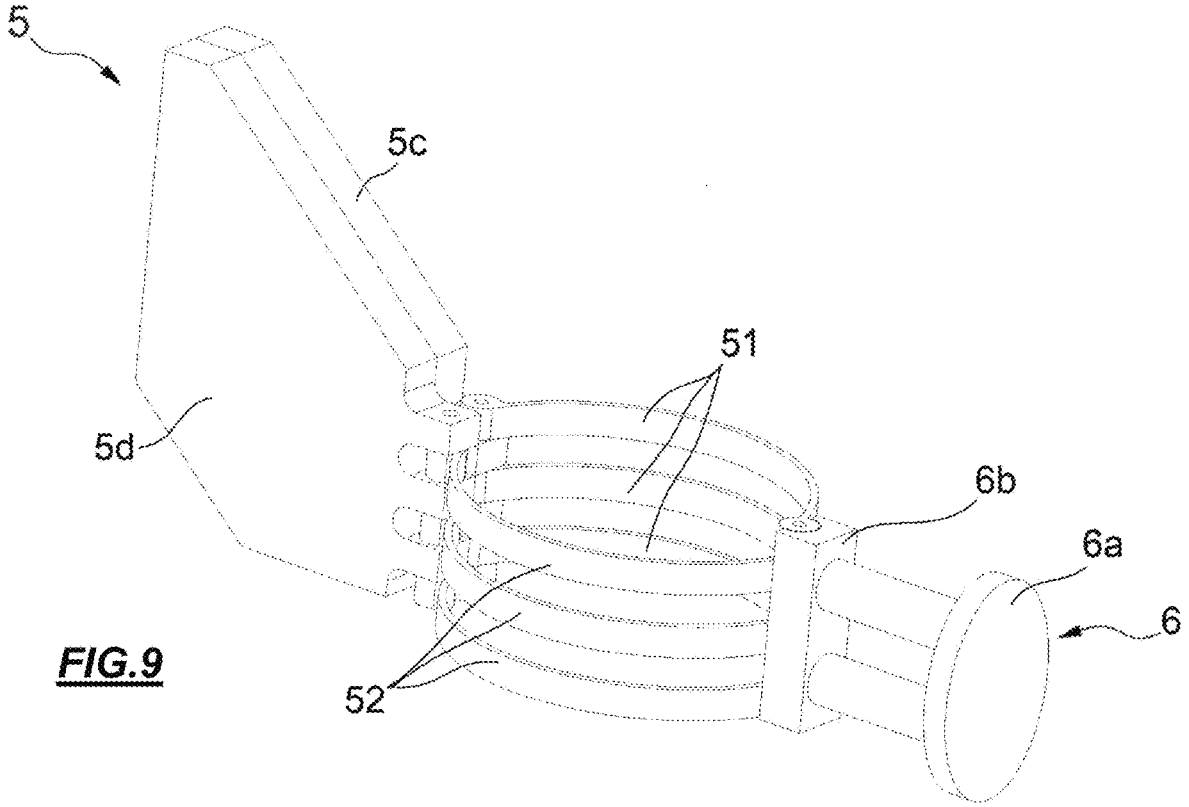
FIG. 9 represents a top view of the pinching mechanism according to the second embodiment in the open position.

In all cases, the pinching mechanism 5 comprises at least one first blade 51 and one second blade 52 deformable in flexion between:

- a closed position (visible in FIGS. 6 and 7) in which the blades 51, 52 are not mechanically constrained and make it possible to keep closed the second side 2*b* of the packaging bag 2, and
- an open position (visible in FIG. 9) in which the blades 51, 52 are mechanically constrained to deform in flexion and thus move away from each other and allow the second side 2*b* of the bag 2 to be released so as to supply the food product(s) contained in the packaging bag 2 through the pouring spout 12*b*.

The dispensing device 1 advantageously makes it possible to facilitate the reloading of a device 1 by replacing the exhausted packaging bag 2 with another filled packaging bag 2. Moreover, the pinching of the second side 2*b* of the packaging bag 2 ensures that the device 1 is not in contact with the product contained in the packaging bag 2. This frees us from cleaning constraints.

Figure 4:
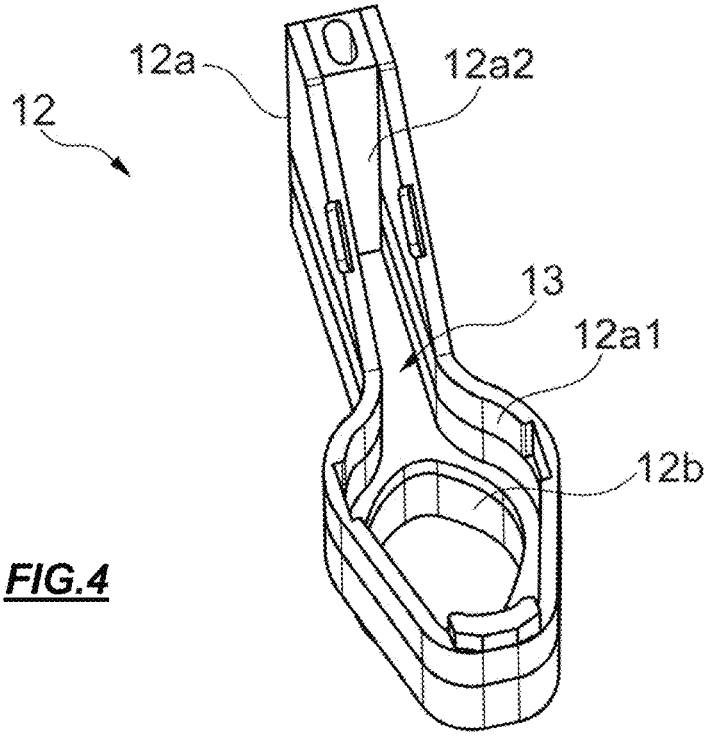
FIG. 4 represents a perspective view of the second part of the device of FIG. 1 or 3.

Referring now to FIG. 4, the body 12*a* of the second part 12 of the device 1 has been shown. The body 12*a* comprises a housing 13 in which can be inserted in a detachable manner, that is to say movable in at least one direction without constraint, the pinching mechanism 5.

The housing 13 of the body 12*a* has at the level of the blades 51, 52 a generally oval shape 12*a*1 to make it possible to limit the spacing of the blades 51, 52 of the pinching mechanism 5. Thus, such a shape allows a mobility of the blades 51, 52 between the open position and the closed position of the pinching mechanism 5.

The generally oval shape 12*a*1 of the body 12*a* of the second part 12 is matched with the pouring spout 12*b* to allow the delivery of the product(s) contained in the packaging bag 2 when the blades 51, 52 are separated.

Figure 5:
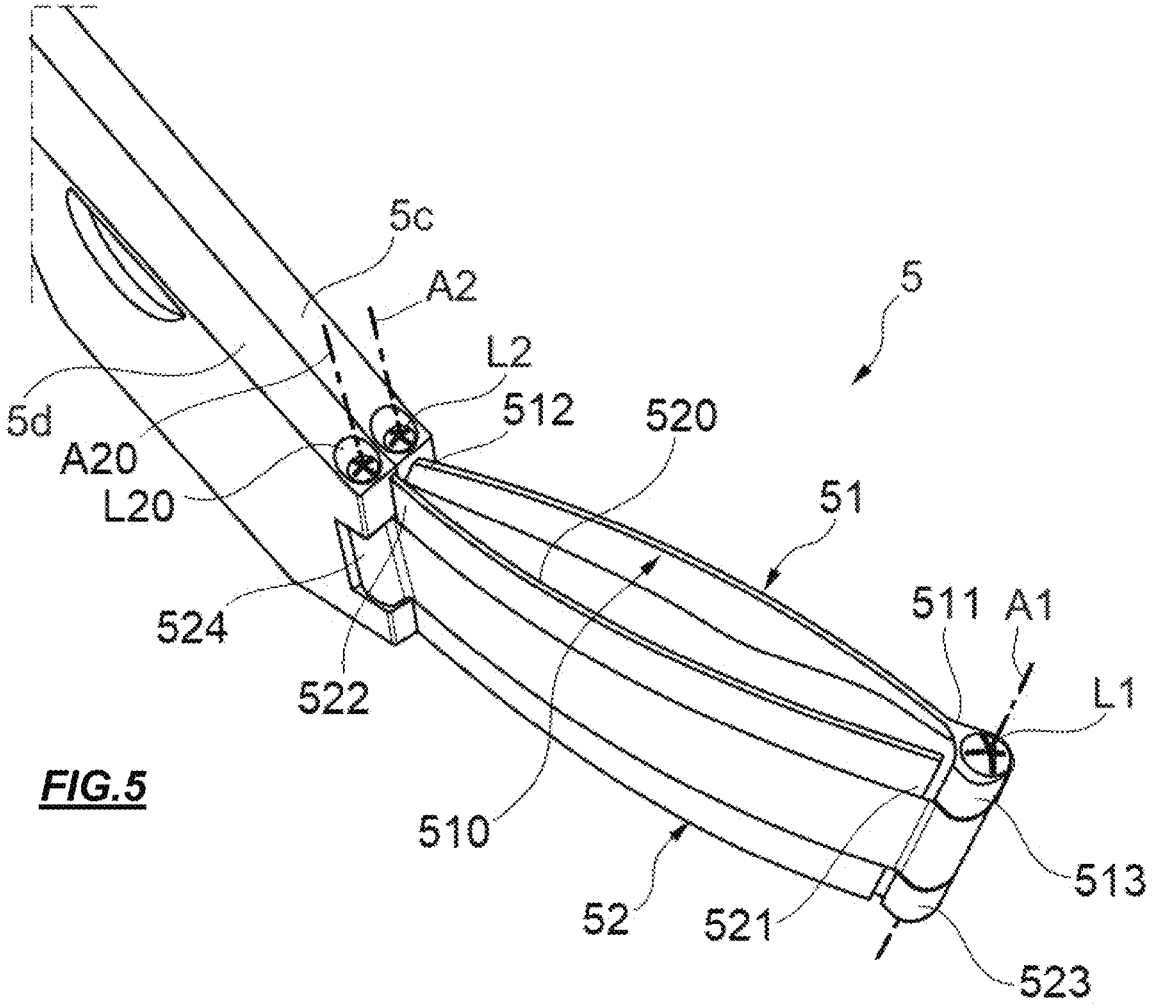
FIG. 5 represents a perspective view of a first embodiment of a pinching mechanism provided to be received in the second part of a device according to the present disclosure.

Referring now to FIG. 5, there is shown a first embodiment of the pinching mechanism 5 of the present disclosure.

The pinching mechanism 5 shown here comprises only two blades 51, 52 hinged relative to each other, each at a first end 511, 521 using a first pivot connection L1 about a same first pivot axis A1. The first pivot connection L1 is here made by means of pivot attachments 513, 523 complementary to each other.

The other end 512, called second end 512, of the first blade 51 comprises a second pivot connection L2 about a second pivot axis A2, and the other end 522, called second end 522, of the second blade 51, 52 comprises another second pivot connection L20 about another second pivot axis A20, parallel to the second pivot axis A2.

Each second pivot connection L2, L20 of the blades 51, 52 is connected to a spacer 5*c*, 5*d* allowing, on the one hand, the separation of the blades 51, 52 when the pinching mechanism 5 is removed from the housing 13 of the body 12*a* and, on the other hand, their placement in the closed position when the pinching mechanism 5 is inserted into this housing 13.

In addition to the generally oval shape 12*a*1, the housing 13 of the body 12*a* has a complementary shape 12*a*2 to the spacers 5*c*, 5*d* so that when the latter are received in the housing 13 they form a clamp configured to clamp a part of the second side 2*b* of the flexible bag 2.

When the pinching mechanism 5 is inserted into the housing 13, the spacers 5*c*, 5*d* ensure a continuous pinching of part of the second side 2*b* of the bag 2 while the first blade 51 and the second blade 52 ensure an intermittent pinching of this second side 2*b* at the dispensing opening, so as to temporarily release the product(s) contained in the bag 2 when the blades 51, 52 are constrained.

Figure 10:
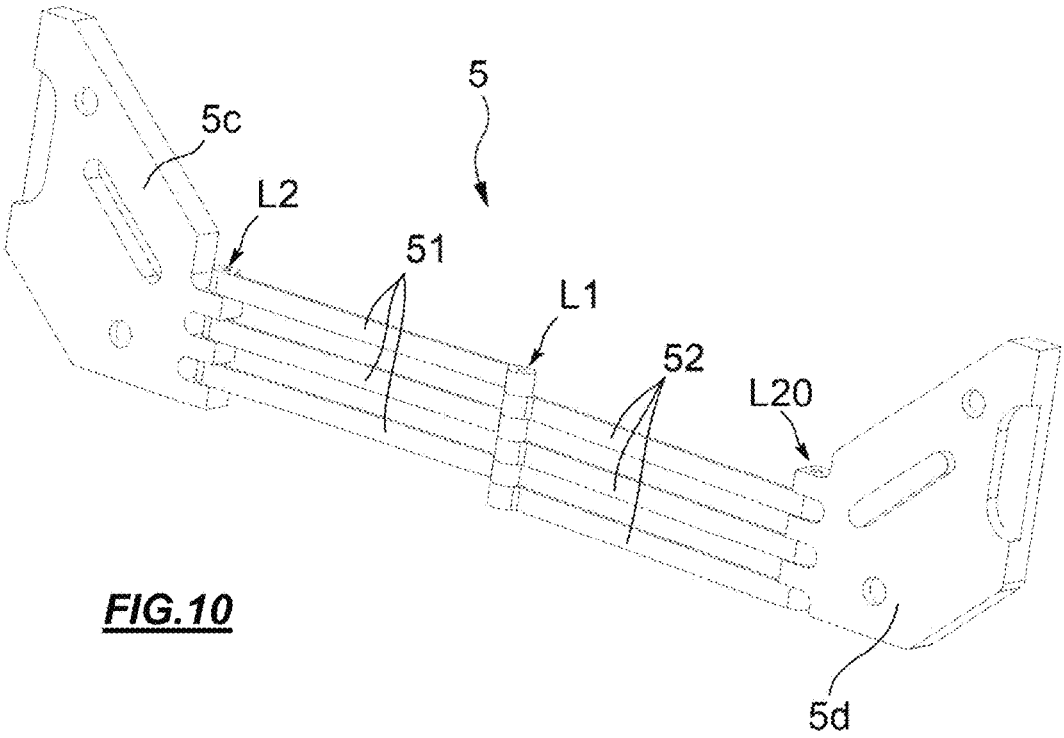
FIG. 10 represents a top view of the pinching mechanism according to the second embodiment, in the unfolded configuration.

When the pinching mechanism 5 is outside the housing 13, it can be unfolded, by pivoting about the first pivot connection L1, as visible in FIG. 10, which facilitates the installation of the pinching mechanism 5 at each change of the bag.

As shown in FIG. 5, the first blade 51 and the second blade 52 can have a predetermined curved profile favoring the bending of the concerned blade 51, 52 in a predetermined direction when these ends 51, 52 are compressed.

It will be understood that such a curved profile prevents the fall of the product(s) contained in the packaging bag 2 since it pinches both the second side 2*b* of the packaging bag 2 and the product(s) at the level of this second side 2*b*.

There is also shown on each internal face 510, 520 of the blades 51, 52 opposed to one another a deformable insulating layer arranged in correspondence with one another.

The deformable insulating layers thus positioned prevent the risk of tearing of the flexible packaging bag 2 at the level of the second side 2*b* by avoiding contact of the blades 51, 52 directly with the packaging bag 2.

Furthermore, the deformable insulating layers make it possible to improve the sealing of the packaging bag 2.

Figure 2:
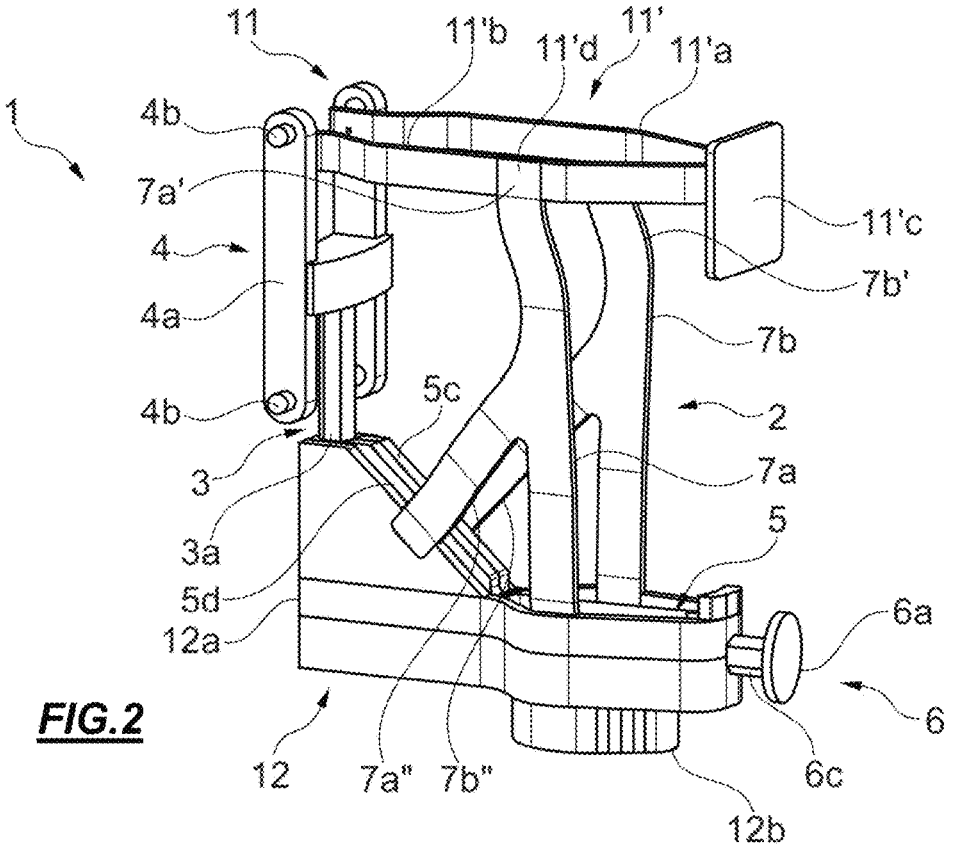
FIG. 2 represents a general perspective view of the dispensing device of FIG. 1 without the flexible packaging bag.
Figure 3:
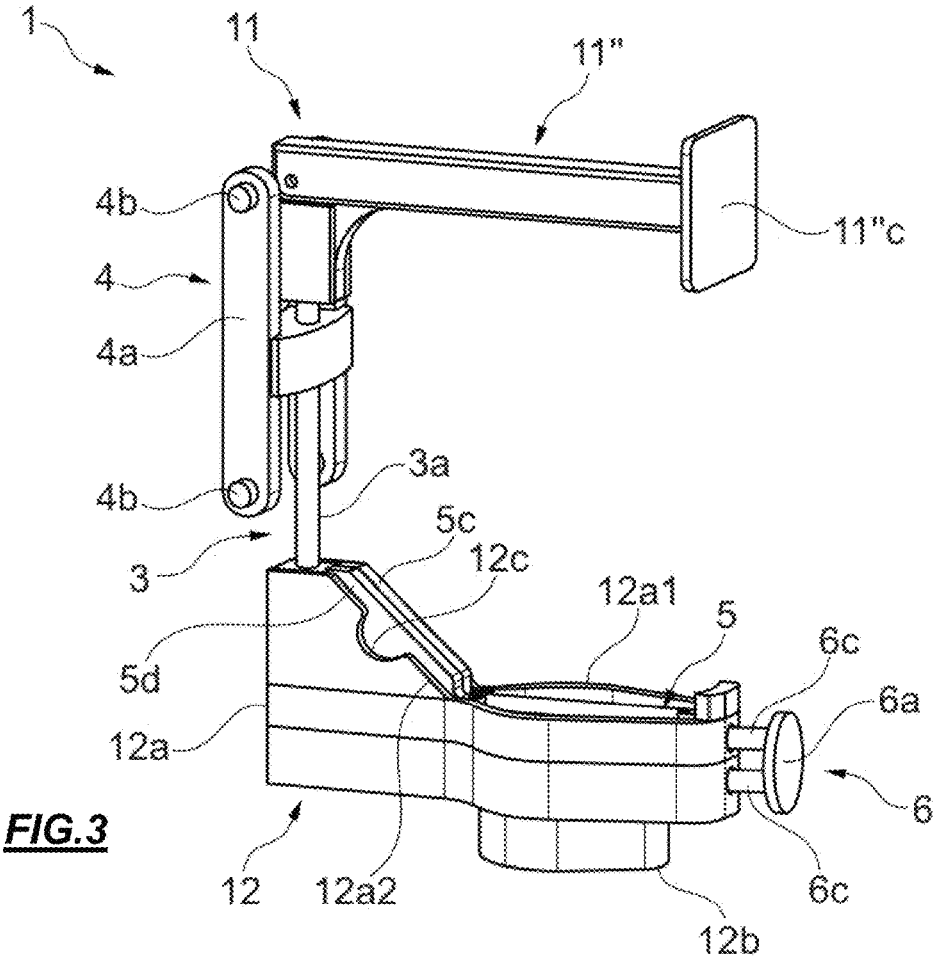
FIG. 3 represents a general perspective view of a second embodiment of a dispensing device according to the present disclosure not equipped with a flexible packaging bag.

Referring to FIGS. 1 to 3, a control mechanism 6 of the blades 51, 52 is shown.

The control mechanism 6 comprises a lever 6*a* connected to a hinge part 6*b* via at least one rod 6*c* passing through the body 12*a* of the second part 12.

The hinge part 6*b* is configured to receive in a detachable manner (here simply by a support) the first pivot connection L1 of the blades 51, 52 of the pinching mechanism 5 and allow their pivoting about the first pivot axis A1.

It is thus possible to manipulate the blades 51, 52 by actuating the lever 6*a*.

When the lever 6*a* is pushed, the hinge part 6*b* pushes the blades 51, 52 via the rod 6*c* sliding in the body 12*a*. The blades 51, 52 are then constrained in deformation, thus allowing their switching from their closed position to their open position. The second side 2*b* of the bag 2 is then released and the product(s) contained in the bag 2 can flow through the pouring spout 12*b*.

When the lever 6*a* is released, the unconstrained blades 51, 52 naturally return to their initial position corresponding to their closed position, thus retaining the product(s) of the packaging bag 2.

Figure 8:
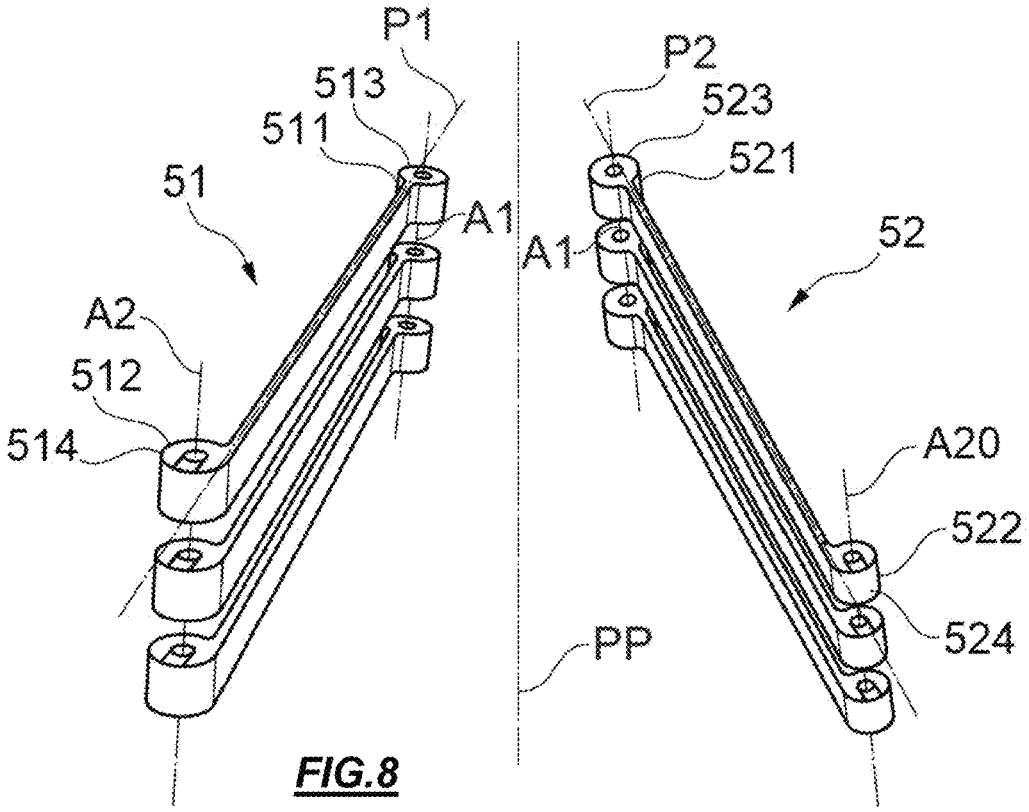
FIG. 8 represents an exploded view of a plurality of first blades and second blades according to the second embodiment.

According to a variant of the pinching mechanism 5 shown in FIG. 8, the or each first blade 51 extends in a first longitudinal plane P1 in the closed position (unflexed configuration) and the or each second blade 52 extends in a second longitudinal plane P2 in the closed position (non-flexed configuration), and the first end 511, 521 of each blade 51, 52 comprises a first pivot attachment 513, 523 having as axis of rotation the first pivot axis A1, and the second end 512, 522 of each blade 51, 52 comprises a second pivot attachment 514, 524 having as axis of rotation the second pivot axis A2 (for the or each first blade 51) or the other second pivot axis A20 (for the or each second blade 52), the first pivot axis A1 and the second pivot axis A2 of the or each first blade 51 being separated by the first longitudinal plane P1 comprising the first blade 51 in the closed position, and the first pivot axis A1 and the other second pivot axis A20 of the or each second blade 52 being separated by the second longitudinal plane P2 comprising the second blade 52 in the closed position.

The arrangement of the first pivot axis A1 and the second pivot axis A2 relative to the first longitudinal plane P1 and the arrangement of the first pivot axis A1 and the other second pivot axis A20 relative to the second longitudinal plane P1 advantageously make it possible to orient the direction of deformation in flexion of the concerned blades 51, 52 when its ends 511, 512, 521, 522 are constrained.

Figure 6:
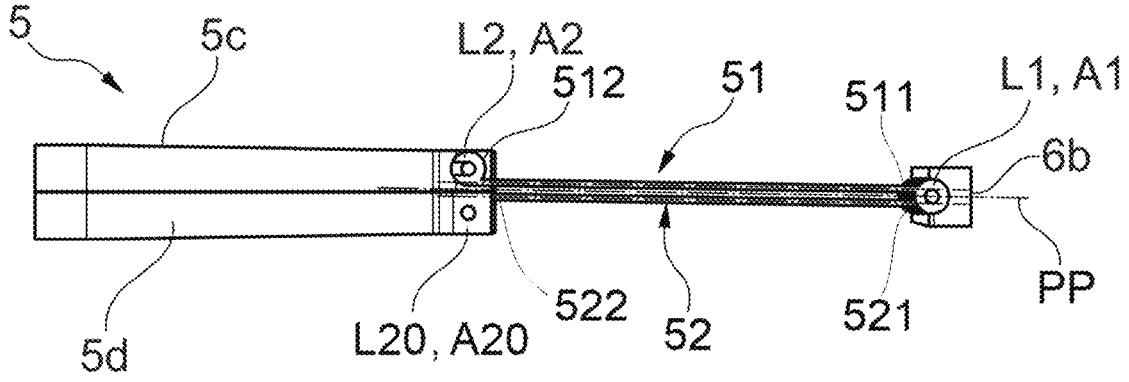
FIG. 6 represents a perspective view of a second embodiment of a pinching mechanism provided to be received in the second part of a device according to the present disclosure.
Figure 7:
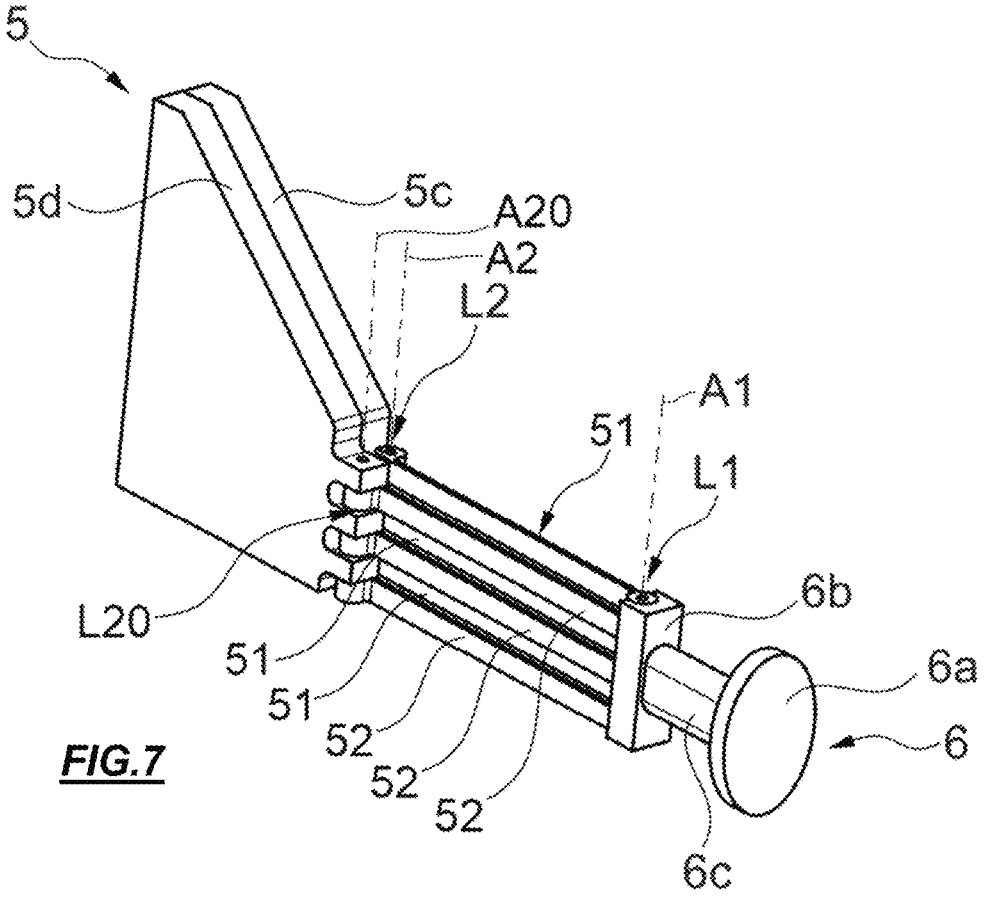
FIG. 7 represents a top view of the pinching mechanism according to the second embodiment in the closed position.

According to a second embodiment of the pinching mechanism 5 shown in FIGS. 7 and 8, it comprises a plurality of first blades 51 and a plurality of second blades 52 produced according to the variant of the pinching mechanism 5 of FIG. 6. And where, the first blades 51 extend in the first longitudinal plane P1 in the closed position and the second blades 52 extend in the second longitudinal plane P2 in the closed position, the first plane P1 and the second plane P2 being distinct and intersecting.

In the configuration shown in FIGS. 7 and 8, the plurality of first blades 51 and the plurality of second blades 52 are arranged so that a first blade 51 is superimposed on a second blade 52 at the level of the first pivot connection L1.

Moreover, the plurality of first blades 51 and the plurality of second blades 52 are mounted symmetrically with respect to a main plane PP separating them.

In FIG. 3, another variant of the present disclosure is shown in which the first part 11 is formed by a support bar 11" configured to allow the attachment of the first side 2*a* of the flexible bag 2, for example using pliers taking the bar 11" and the first side 2*a* of the packaging bag 2. Furthermore, the support bar 11" comprises at its end a label holder 11"*c* allowing the display of information relating to the product(s) contained in the flexible packaging bag 2.

It will also be noted that the body 12*a* of the second part 12 has two notches 12*c* allowing the spacers 5*c*, 5*d* to be grasped by two fingers in order to remove the pinching mechanism 5 from the housing 13.

As shown in FIGS. 1 to 3, the adjustment means 3 comprises a telescopic bar 3*a* slidably mounted relative to the body 12*a* of the second part 12.

The hooking mechanism 4 comprising fixing lugs 4*a* from which hooking pins 4*b* extend for suspending the dispensing device 1 from a display.

The hooking mechanism 4 is advantageously adjustably mounted in position on the telescopic bar 3*a*.

Referring to FIG. 2, the device 1 of FIG. 1 not equipped with the packaging bag 2 as shown in FIG. 1, this in order to better illustrate a structure 7 for constraining the flexible packaging bag 2.

The constraining structure 7 disposed between the first part 11 and the second part 12 comprises longitudinal reinforcements 7*a*, 7*b* configured to clamp the flexible bag 2 and constrain the product it contains towards the pouring spout 12*b*.

These longitudinal reinforcements 7*a*, 7*b* are secured to the second part 12 and extend to the first part 11 where free ends 7*a*", 7*b*" are engaged in notches 11'*d* of the crown 11' of the first part 11. Such a configuration advantageously ensures stable maintenance of the crown 11'.

The longitudinal reinforcements 7*a*, 7*b* comprise constriction portions 7*a*, 7*b*" of the flexible packaging bag 2 provided at the level of the spacers 5*c*, 5*d* in order to constrain the product(s) contained in the packaging bag 2 towards the pouring spout 12*b*.

Obviously, the present disclosure is not limited to the examples which have just been described and numerous adjustments can be made to these examples without departing from the scope of the present disclosure. In particular, the different characteristics, shapes, variants and embodiments of the present disclosure can be associated with each other in various combinations to the extent that they are not incompatible or exclusive of each other. In particular, all the variants and embodiments described above can be combined with each other.

The invention claimed is:

1. A dispensing device for bulk dispensing at least one food product, the dispensing device comprising a first part and a second part configured for holding a flexible packaging bag containing the at least one food product, the first part is configured to allow the suspension of a first side of the bag, the second part comprises a pouring spout supporting a pinching mechanism and a control mechanism for controlling the pinching mechanism, the pinching mechanism being configured to allow the pinching of a second side of the bag opposite the first side, wherein the pinching mechanism comprises at least one first blade and one second blade deformable in flexion between:

a closing position in which the at least one first blade and the one second blade are not mechanically constrained by the control mechanism and are configured to keep the second side of the bag closed and, an open position in which the at least one first blade and the one second blade are mechanically constrained by the control mechanism to be deformed in flexion and thus move away from each other to release the second side of the bag so as to deliver the food product through the pouring spout.

2. The dispensing device according to claim 1, wherein one end of the at least one first blade is connected to an end of the one second blade by a pivot connection about the same pivot axis.

3. The dispensing device according to claim 2, wherein the end of the at least one first blade, called first end, is connected to the end of the one second blade by the pivot connection, called first pivot connection, about the pivot axis, called first pivot axis, and an other end, called second end, of the at least one first blade is connected to a second pivot connection about a second pivot axis, and an other end, called second end, of the one second blade is connected to another second pivot connection about another second pivot axis.

4. The dispensing device according to claim 3, wherein the second pivot connection and the another second pivot connection are each connected to a spacer.

5. The dispensing device according to claim 2, wherein the control mechanism is movable in translation relative to the second part, the control mechanism being configured to detachably receive the pivot connection, called first pivot connection, of the at least one first blade and the one second blade of the pinching mechanism and allow their pivoting about the pivot axis, called first pivot axis.

6. The dispensing device according to claim 5, wherein the control mechanism comprises a hinge part ensuring the pivoting of the at least one first blade and the one second blade about the pivot axis, the first pivot axis, the hinge part being secured to at least one rod passing through the second part to be connected to a lever.

7. The dispensing device according to claim 1, wherein the second part comprises a housing having, at a level of the at least one first blade and the one second blade, a generally oval shape limiting an authorized stroke of the at least one first blade and the one second blade of the pinching mechanism.

8. The dispensing device according to claim 4, wherein the second part comprises a housing having, at a level of the at least one first blade and the one second blade, a generally oval shape limiting an authorized stroke of the at least one first blade and the one second blade of the pinching mechanism and the housing of the second part further has a shape complementary to the spacer so that when spacer is received in the housing it forms a clamp configured to clamp a part of the second side of the flexible bag.

9. The dispensing device according to claim 1, wherein the at least one first blade and the one second blade each have a predetermined curved profile allowing spacing relative to each other.

10. The dispensing device according to claim 3, wherein the at least one first blade extends in a first longitudinal plane and the one second blade extends in a second longitudinal plane in the closing position, the first end of at least one first blade and the one second blade comprises a first pivot attachment having the first pivot axis as its axis of rotation, and the second end of the at least one first blade comprises a second pivot attachment having the second pivot axis as its axis of rotation, and the second end of the one second blade comprises a second pivot attachment having the another second pivot axis as its axis of rotation;

the first pivot axis and the second pivot axis of the at least one first blade being separated by the first longitudinal plane and the first pivot axis and the another second pivot axis of the one second blade being separated by the second longitudinal plane in the closing position.

11. The dispensing device according to claim 1, wherein the pinching mechanism comprises a plurality of first blades and a plurality of second blades.

12. The dispensing device according to claim 11, wherein the plurality of first blades extend in a first longitudinal plane in the closing position, the plurality of second blades extend in a second longitudinal plane in the closing position, the first plane and the second plane being distinct.

13. The dispensing device according to claim 1, wherein the first part and the second part are separated from each other by adjustment means.

14. The dispensing device according to claim 1, wherein the device comprises a structure for constraining the flexible packaging bag, disposed between the first part and the second part, the structure comprising reinforcements configured to clamp the flexible bag and constrain the product(s) it contains towards the pouring spout.

15. A system for bulk storing and dispensing at least one food product, comprising a dispensing device according to claim 1, and further comprising a flexible packaging bag containing the at least one food product, the bag having a first side and a second side opposite each other, wherein the first side of the bag is suspended on the first part of the device and the pinching mechanism allows the pinching of the second side.

16. The dispensing device according to claim 4, wherein the control mechanism is movable in translation relative to the second part, the control mechanism being configured to detachably receive the pivot connection, called first pivot connection, of the at least one first blade and the one second blade of the pinching mechanism and allow their pivoting about the pivot axis, called first pivot axis.

17. The dispensing device according to claim 16, wherein the control mechanism comprises a hinge part ensuring the pivoting of the at least one first blade and the one second blade about the pivot axis, the first pivot axis, the hinge part being secured to at least one rod passing through the second part to be connected to a lever.

18. The dispensing device according to claim 17, wherein the second part comprises a housing having, at a level of the at least one first blade and the one second blade, a generally oval shape limiting an authorized stroke of the at least one first blade and the one second blade of the pinching mechanism.

19. The dispensing device according to claim 18, wherein the at least one first blade and the one second blade each have a predetermined curved profile allowing spacing relative to each other.

20. The dispensing device according to claim 19, wherein the pinching mechanism comprises a plurality of first blades and a plurality of second blades.

* * * * *